US009618281B2

(12) United States Patent
Colpan et al.

(10) Patent No.: US 9,618,281 B2
(45) Date of Patent: Apr. 11, 2017

(54) HEAT EXCHANGE DEVICE

(75) Inventors: Oguzhan Colpan, Waterford, MI (US); Jeffrey V. Basinski, Grand Blanc, MI (US)

(73) Assignees: Denso International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 1326 days.

(21) Appl. No.: 13/045,982

(22) Filed: Mar. 11, 2011

(65) Prior Publication Data

US 2011/0259558 A1 Oct. 27, 2011

Related U.S. Application Data

(60) Provisional application No. 61/326,958, filed on Apr. 22, 2010.

(51) Int. Cl.

| | |
|---|---|
| ***F01P 3/18*** | (2006.01) |
| ***F28F 9/00*** | (2006.01) |
| ***F01P 1/10*** | (2006.01) |
| ***F01P 5/06*** | (2006.01) |
| *F28D 21/00* | (2006.01) |

(52) U.S. Cl.

CPC ..... *F28F 9/002* (2013.01); *F01P 1/10* (2013.01); *F01P 5/06* (2013.01); *F01P 3/18* (2013.01); *F01P 2070/50* (2013.01); *F28D 2021/0094* (2013.01)

(58) Field of Classification Search

CPC ..... F28F 9/001; F28F 9/002; F28F 2275/085; F28D 1/0233; F28D 2001/0266; F28D 2021/0091; F28D 2021/0094; F01P 2070/50; F01P 3/18; F16B 21/18; F16B 21/186; F16B 7/04; F16B 5/06; F16B 5/0621; F16B 5/0628; B62D 25/084; B60K 11/04; B60R 19/52; F16M 13/02; F24D 19/02; F24D 19/0209; F24D 19/0216; F24D 19/0256; F24D 19/0259; F24D 19/0276; F24D 19/0279; F24D 19/0283; F24D 19/0289; A47B 96/06; A47B 96/061

USPC ... 165/41, 44, 51, 67, 76–78, 120, 121, 148, 165/149, 151, 152, 153, 172, 173, 175; 180/68.4, 68.6; 403/326, 329, 397; 248/220.21, 222.12, 221.11, 232, 220.22, 248/300, 911

See application file for complete search history.

(56) References Cited

U.S. PATENT DOCUMENTS

| | | | | |
|---|---|---|---|---|
| 3,980,132 A | | 9/1976 | Mitchell et al. | |
| 4,856,746 A | * | 8/1989 | Wrobel et al. | 248/250 |
| 5,341,871 A | | 8/1994 | Stelzer | |
| 5,474,121 A | * | 12/1995 | Bryson | B60K 11/02 165/122 |

(Continued)

*Primary Examiner* — Ryan J Walters
*Assistant Examiner* — For K Ling
(74) *Attorney, Agent, or Firm* — Harness, Dickey & Pierce, P.L.C.

(57) ABSTRACT

A heat exchanger having a heat exchange surface comprising a plurality of tubes, a pair of tanks, an end plate, and a shroud disposed to cover the heat exchange surface, wherein, the shroud provides a first hook and a second hook at it's a vertical wall, and the end plate is held in place either between the first hook and the second hook, or between the second hook and the vertical wall. With the above structure, the fan shroud assembly can hold two types of heat exchangers having different thickness.

15 Claims, 5 Drawing Sheets

(56) References Cited

U.S. PATENT DOCUMENTS

| | | | | |
|---|---|---|---|---|
| 5,582,376 | A * | 12/1996 | Thompson | 248/214 |
| 5,704,418 | A * | 1/1998 | Baader et al. | 165/121 |
| 6,237,676 | B1 * | 5/2001 | Hasegawa | B60K 11/04 165/140 |
| 6,408,933 | B2 * | 6/2002 | Fukuoka et al. | 165/67 |
| 6,510,891 | B2 * | 1/2003 | Anderson | B60K 11/04 165/121 |
| 6,682,319 | B2 | 1/2004 | Kobayashi | |
| 6,691,767 | B2 * | 2/2004 | Southwick | B60K 11/04 165/67 |
| 7,007,744 | B2 * | 3/2006 | Kalbacher | 165/67 |
| 7,040,380 | B1 * | 5/2006 | O'Brien | 165/67 |
| 7,044,203 | B2 | 5/2006 | Yagi et al. | |
| 7,117,927 | B2 * | 10/2006 | Kent et al. | 165/67 |
| 7,287,574 | B2 * | 10/2007 | Desai | F28D 1/0435 165/140 |
| 2005/0121170 | A1 * | 6/2005 | Maeda | F28D 1/0435 165/67 |
| 2008/0099641 | A1 * | 5/2008 | Best et al. | 248/220.22 |

* cited by examiner

HEAT EXCHANGE DEVICE

CROSS-REFERENCE TO RELATED APPLICATIONS

This application claims the benefit of U.S. Provisional Application No. 61/326,958, filed on Apr. 22, 2010. The entire disclosure of the above application is incorporated herein by reference.

FIELD

The present disclosure relates to a heat exchange device for a vehicle.

BACKGROUND

This section provides background information related to the present disclosure, which is not necessarily prior art.

The heat exchange device for a vehicle generally comprises the combination of a heat exchanger and fan shroud assembly. The fan shroud assembly is fixed to the heat exchanger at its vehicle side-to-side end portions by bolts.

With regard to larger vehicles, due to their large sized radiator, there may be a need for additional clips at the top portion of the heat exchange device.

The above heat exchange device has proven satisfactory for its intended purpose, but because of the difference of the thickness of the heat exchanger, the same kind of fan shroud assembly can not apply to multiple kinds of heat exchangers in various vehicles without difficulty.

SUMMARY

In order to make one kind of shroud assembly adaptable to multiple kinds of heat exchangers, the present invention describes a heat exchange device comprising a heat exchanger and an adaptable shroud. The heat exchanger comprising a plurality of tubes stacked in the vertical direction, a pair of tanks disposed on both end sides of the plurality of tubes, and an end plate disposed on a top end portion of the plurality of tubes.

A fan, which generates airflow passing through the heat exchanger. A motor connected to the axis of the fan. A shroud attached to the heat exchanger, and the shroud guides the airflow. The shroud further provides a first hook and a second hook at a vertical wall of the shroud. One of the first hook and the second hook is attached to the heat exchanger. The first hook embodies a first plate portion, wherein the first plate portion defines a first gap between the first plate portion and the vertical wall.

The second hook embodies a second plate portion, wherein the second plate portion defines a second gap between the second plate portion and the vertical wall. The first gap is defined as greater than the second gap, and the end plate of the heat exchanger is held between either the first plate portion and the second plate portion, or between the second plate portion and the vertical wall.

With the above structure, the shroud can hold two kinds of heat exchangers, which have different thickness.

Another aspect of this disclosure is the second plate portion has a first protrusion protruding towards the end plate. With the above structure, the shroud can hold the end plate more tightly.

Another aspect of this disclosure is the second plate portion has a nick residing around the first protrusion. With the above structure, the second plate around the first protrusion can bend and the first protrusion can press the end plate due to the elasticity of the bent second plate.

Another aspect of this disclosure is, the vertical wall has a second protrusion protruding towards the end plate. With the above structure, the shroud can hold the end plate more tightly.

Another aspect of this disclosure is the vertical wall has a nick residing around the second protrusion. With the above structure, the vertical wall around the second protrusion can bend and the second protrusion can press the end plate due to the elasticity of the bent vertical wall.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding elements throughout the several views of the drawings.

DETAILED DESCRIPTION

The preferred and other embodiments will now be described more fully with reference to FIGS. 1-6 of the accompanying drawings.

Figure 1:
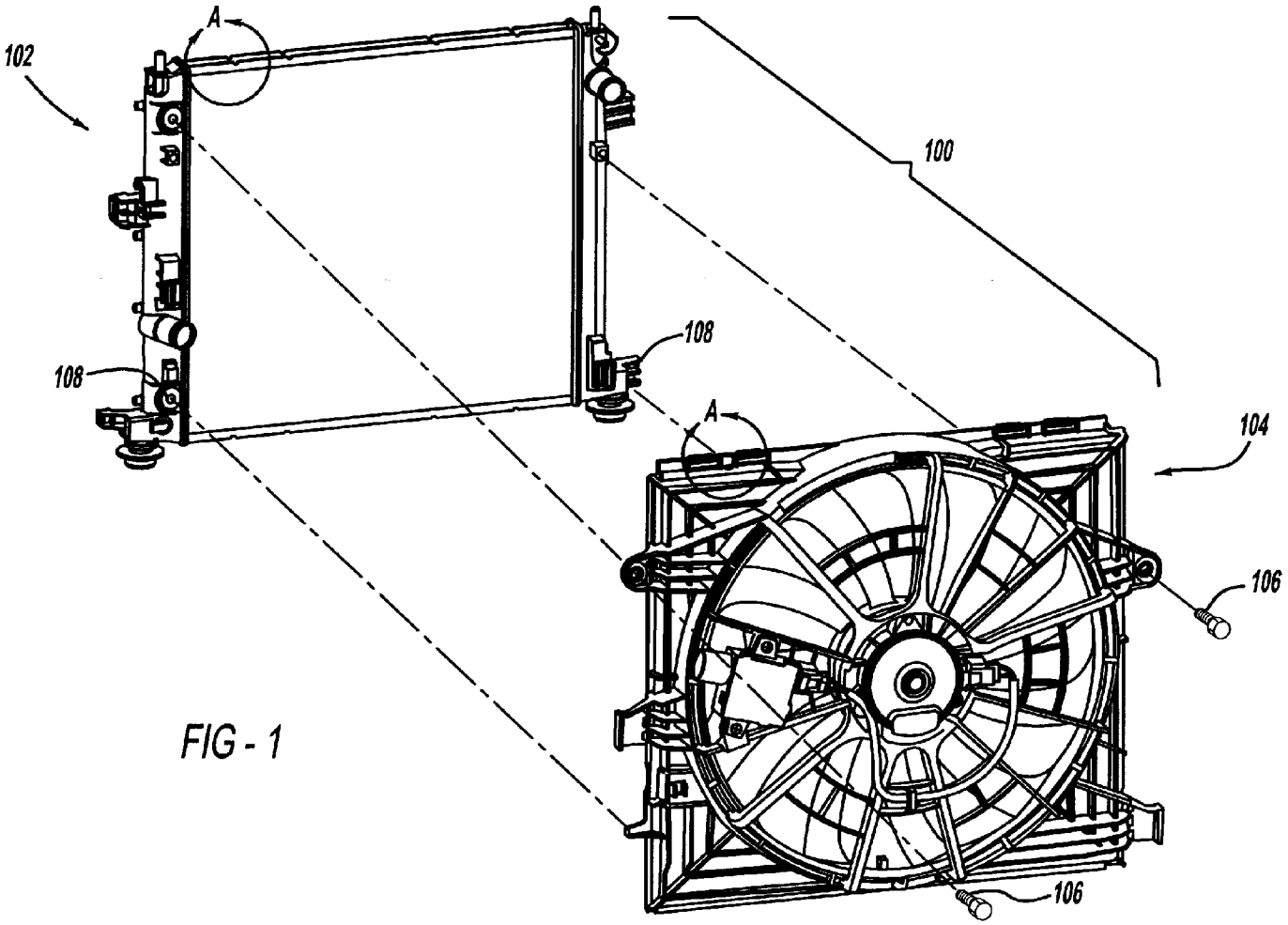
FIG. 1 is an exploded perspective view of a heat exchange device in the present disclosure.

FIG. 1 is an exploded perspective view of a heat exchange device 100 in the present disclosure. The heat exchange device 100 comprises a heat exchanger 102, in which a media exchanging heat with a vehicle heat source (not shown) flows and a shroud assembly 104 attached to the heat exchanger 102. The shroud assembly 104 is fixed to the heat exchanger 102 by bolts 106, and engaging portions 108. Such heat exchange device 100 is disposed in the vehicle front end to radiate the vehicle's waste heat.

Figure 2:
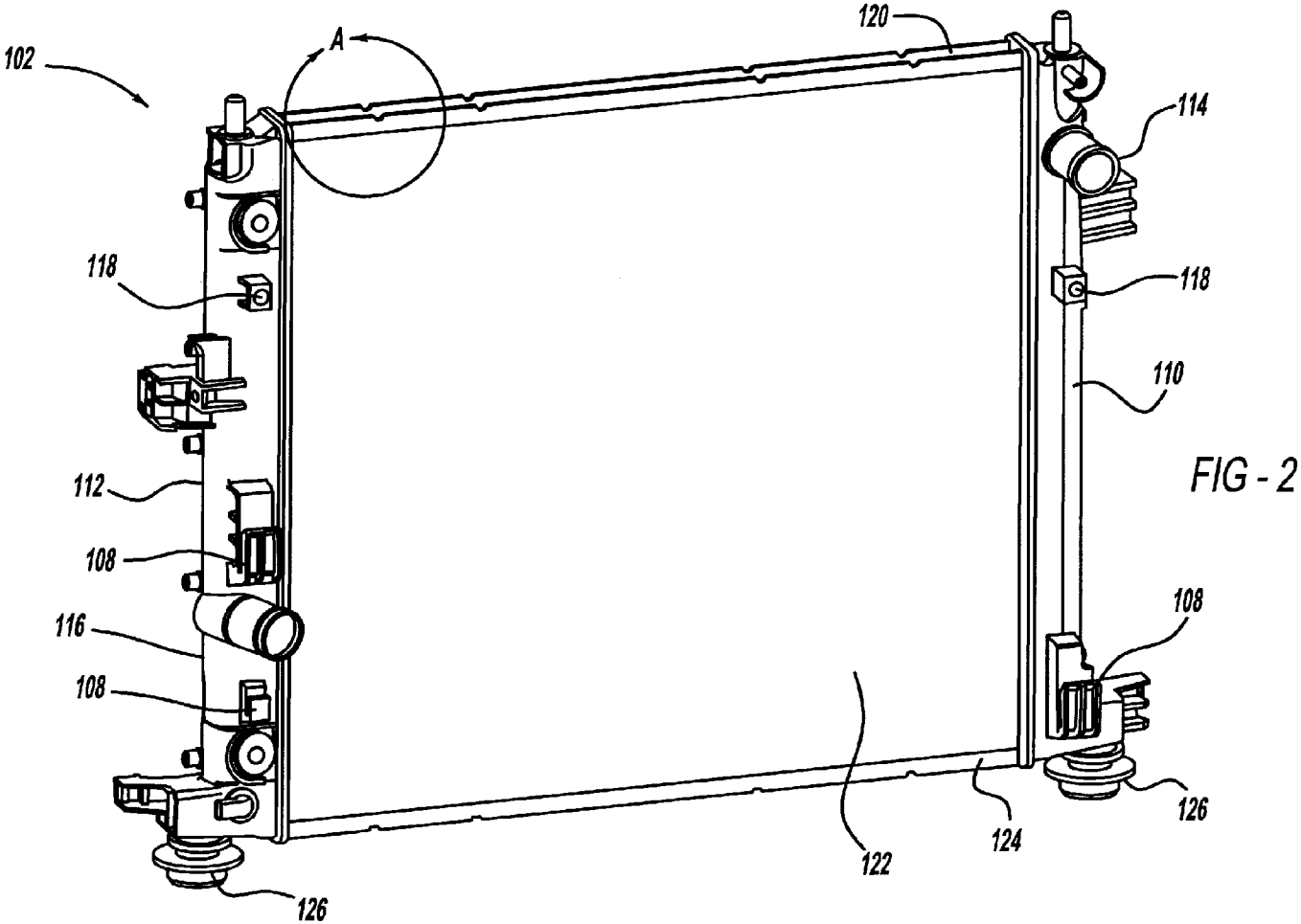
FIG. 2 is a perspective view of a heat exchanger in the present disclosure.

Turning to the FIG. 2, FIG. 2 is a perspective view of a heat exchanger 102 in the present disclosure. The heat exchanger 102 in this embodiment is the radiator, which radiates vehicle waste heat. Heat exchanger 102 has inlet tank 110 and outlet tank 112. The Inlet tank 110 has inlet port 114. The outlet tank 112 has outlet port 116. Both tanks 110 and 112 have engaging portions 108 and bolt holes 118. The heat exchanger 102 further has a heat exchanger core surface 122 and end plates 120, 124. The heat exchange surface 122 is formed by horizontally extending fins and tubes stacked up in the vertical direction. The tubes are connected to the inlet tank 110 and outlet tank 112. The fins are disposed between the tubes. The end plates 120, 124 are disposed at the top and bottom end of the heat exchange surface 122. The end plates 120, 124 define the edges of the heat exchanger 102. The heat exchanger 102 is mounted on the vehicle via the mounting rubbers 126.

Figure 3:
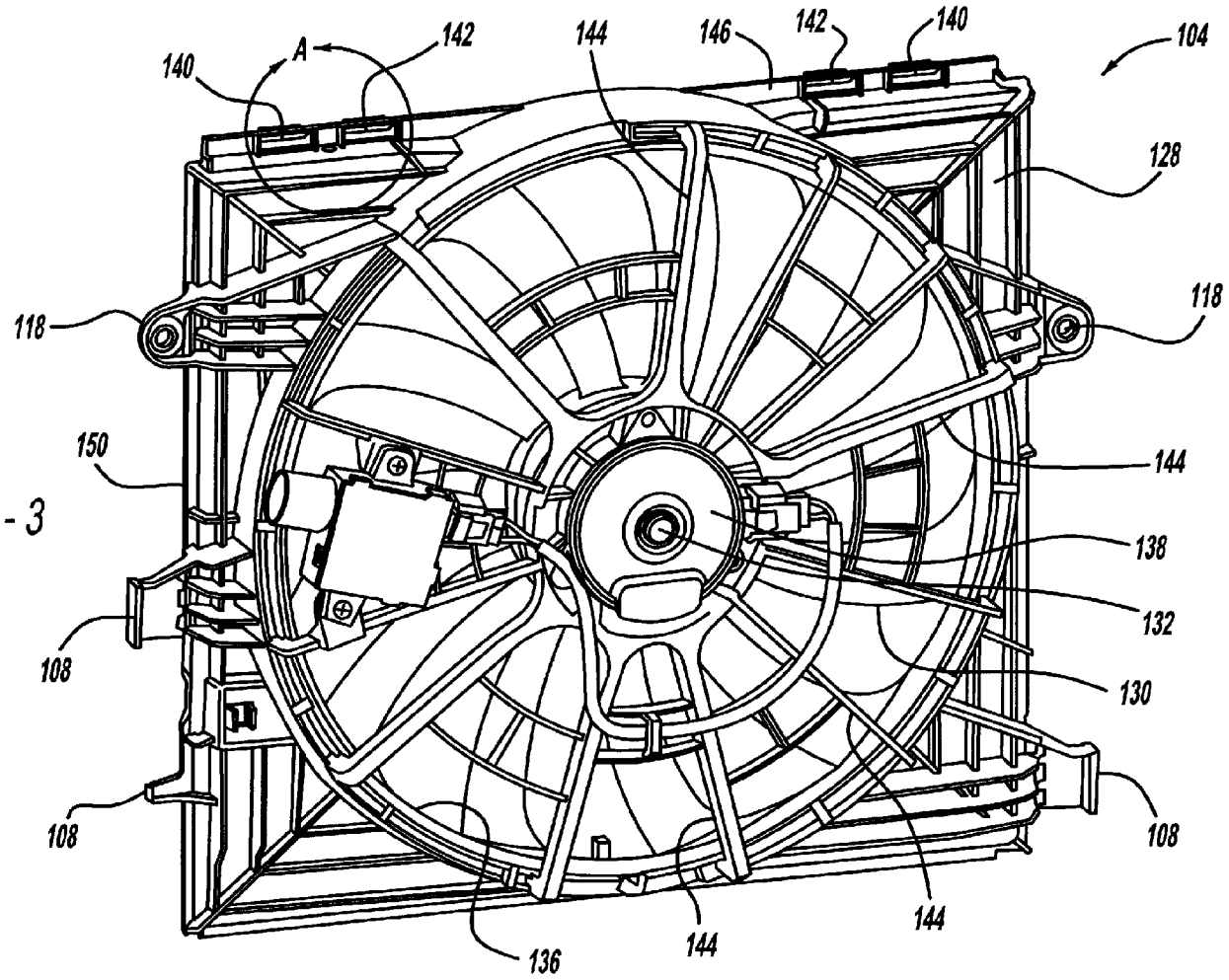
FIG. 3 is a perspective view of the shroud assembly in the present disclosure.

Turning to FIG. 3, FIG. 3 shows a perspective view of the shroud assembly 104 in this embodiment. The shroud assembly 104 has a fan 130, a motor 132 and a shroud 128. The fan 130 is an axial flow fan. The fan 130 is disposed to face the heat exchange surface 122. The motor 132 may be either an axial gap motor or a radial gap motor. The shroud 128 is attached to the heat exchanger 102, and guides the airflow. The shroud 128 has a rectangular shape frame 134 with a circular hole 136 and motor stay 138. The motor 132 is attached to the motor stay 138. The motor stay 138 is disposed center of the center hole 136, and supported by a plurality of spokes 144. The spokes 144 are connected to the frame 134. The frame 134 has bolt holes 118 and engaging portions 108 in its vehicle side to side ends. The frame 134 has vertical wall 146 in its vertical top end portion. The vertical wall provides first hooks 140 and second hooks 142 and second protrusions 148 (not shown in FIG. 3, but shown in FIG. 4 and FIG. 6). One of the first hook 140 and the second hook 142 is attached to the heat exchanger 102. The motor 132 is controlled by the fan controller 150. The fan controller 150 is mounted on the spokes 144.

Figure 4:
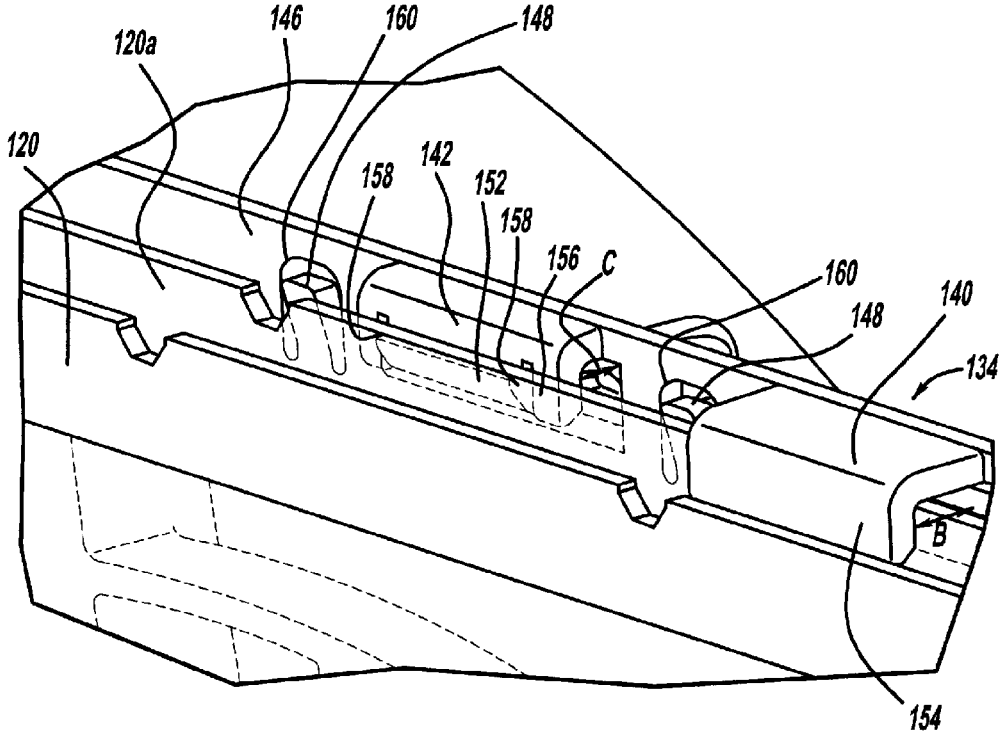
FIG. 4 is an enlarged view of the heat exchange device showing the hook and the protrusion holding a relatively thin tube radiator.

Turning to FIG. 4, FIG. 4 is an enlarged view of the heat exchange device 100 corresponding to the circled portion A depicted in FIG. 1 though FIG. 3 viewing from the heat exchanger 102 side. FIG. 4 shows the first hook 140, the second hook 142, first protrusion 152 and the second protrusion 148. In FIG. 4, the frame 134 of the fan shroud assembly 104 holds a relatively thin tube radiator by using the first hook 140 and first protrusion 152.

The end plate 120 of the heat exchanger 102 has a U-shaped cross sectional area. The vertical wall 146 of the frame 134 is disposed parallel to a vertical portion 120*a* of the end plate 120. The vertical wall 146 provides the first hook 140, the second hook 142, and second protrusion 148. In this embodiment, the edge of the end plate 120 is caught between the first hook 140 and the second hook 142. The first hook 140 and the second hook 142 are offset from each other.

More specifically, the first hook 140 has a first plate portion 154. The first plate portion 154 defining a first gap B between its one flat surface and the vertical wall 146 of the frame 134. The second hook 142 has a second plate portion 156. The second plate portion 156 defines a second gap C between its one flat surface and the vertical wall 146 of the frame 134. The gap B is greater than the gap C. The first plate portion 154 and the second plate portion 156 are approximately parallel to the vertical wall 146 and the vertical portion 120*a*. In this embodiment, both the first hook 140 and the second hook 142 have L shaped cross sectional areas cutting along the vehicle front to rear direction.

The first protrusion 152 is provided on the second plate portion 156. The first protrusion 152 protrudes towards the vertical portion 120*a* of the end plate 120. The second plate portion 156 has a pair of first nicks 158, the first nicks 158 residing around the first protrusion 152. More specifically, the first nicks 158 reside around both sides of the first protruding portion 152 and reach the lower end portion of the second plate portion 156.

Accordingly, the fan shroud assembly 104 can hold the end plate 120 more tightly by the first protrusion 152. The second plate portion 156 around the first protrusion 152 can bend and can press the end plate 120, due to the elasticity of the bent second plate portion 156.

Figure 5:
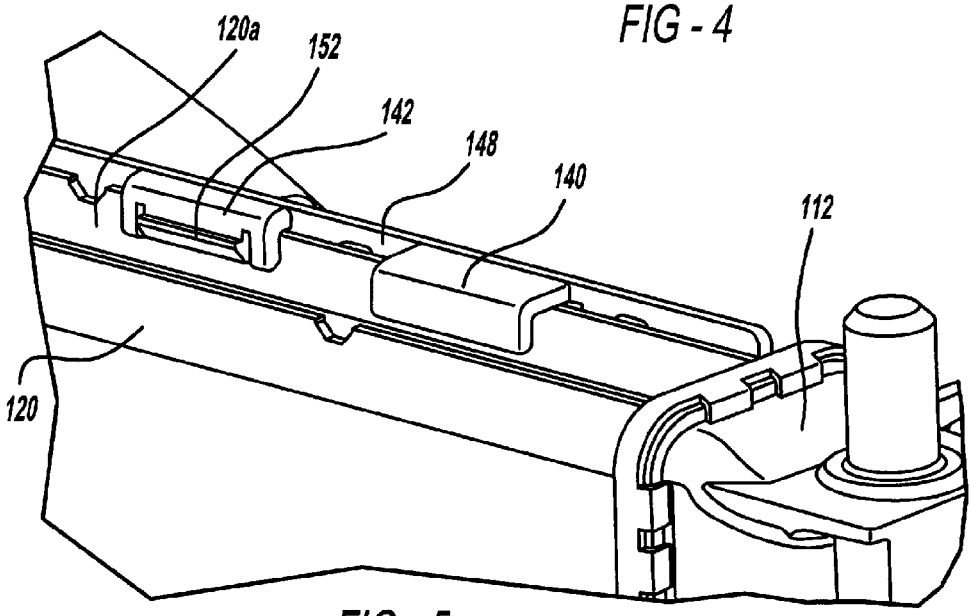
FIG. 5 is an enlarged view of the heat exchange device showing the hook holding a relatively thick tube radiator.

Turning to FIG. 5, FIG. 5 is an enlarged view of the heat exchange device 100, corresponding to the circled portion A depicted in FIG. 1 though FIG. 3 viewing from the heat exchanger 102 side. FIG. 5 shows the first hook 140, the second hook 142, first protrusion 152 and the second protrusion 148. In FIG. 5, the fan shroud assembly 104 holds a relatively thick tube radiator by using the second hook 142 and second protrusion 148.

Figure 6:
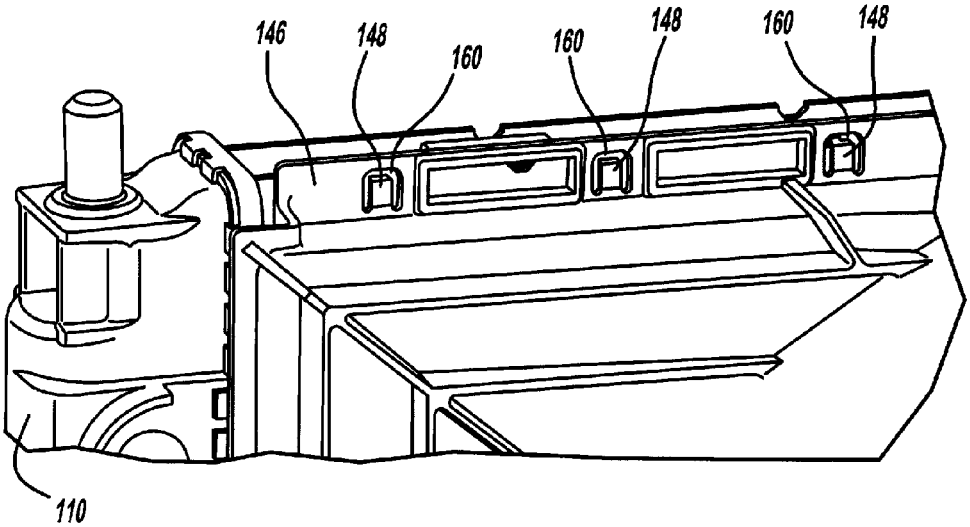
FIG. 6 is another view of the heat exchange device depicted in FIG. 5 viewing from the shroud assembly side.

Turning to FIG. 6, FIG. 6 is an enlarged view of the heat exchange device 100 showing the second protrusions 148, and second nicks 160 viewing from opposite side from the view point of FIG. 5.

The second protrusions 148 are disposed on the vertical wall 146 and between the first hook 140 and the second hook 142. The second protrusions 148 are surrounded by the second nicks 160. The second nicks 160 are upside-down U-shape. The vertical wall 146 surrounded by the second nick 160, provides the second protrusion 148. The second protrusion 148 is bent towards the end plate 120 so as to be relatively protruding from the vertical wall 146.

Accordingly, the fan shroud assembly 104 can hold the end plate 120 more tightly by the second protrusions 148. The vertical wall 146 around the second protrusion 148 can bend, and can press against the end plate 120 due to the elasticity of the bent vertical wall 146.

Although the thin tube radiator depicted in FIG. 4, and the thick tube radiator depicted in FIGS. 5 and 6 have the same width tanks 110 and 112, due to the difference of the thickness of the tubes and end plates 120, the thin tube radiator depicted is different from the thick tube radiator. Accordingly, the shroud assembly 104 can hold two types of heat exchangers having different thickness.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claim is:

1. A heat exchange device for a vehicle comprising:

a heat exchanger;

a fan generating an airflow passing through the heat exchanger;

a motor connected to an axis of the fan; and a shroud attached to the heat exchanger, the shroud including:

a vertical wall defining a longitudinal direction that is substantially perpendicular to said air flow direction;

a first hook extending from the vertical wall towards the heat exchanger, the first hook including a first plate portion defining a first gap between the first plate portion and the vertical wall;

a second hook extending from the vertical wall towards the heat exchanger, the second hook including a second plate portion defining a second gap between the second plate portion and the vertical wall, the second gap is less than the first gap;

a first protrusion of the second hook protrudes toward the heat exchanger and is elastically bendable; and a second protrusion protrudes from the vertical wall toward the heat exchanger and is elastically bendable;

wherein the first hook and the second hook are longitudinally offset from each other;

wherein:

the first hook and the second hook hold the heat exchanger in the first gap by elastically clamping an end plate of the heat exchanger between the first plate portion and the first protrusion when the heat exchanger has a first thickness; and the second hook and the second protrusion hold the heat exchanger in the second gap by elastically clamping the end plate of the heat exchanger between the second plate portion and the second protrusion when the heat exchanger has a second thickness that is greater than the first thickness.

2. The heat exchange device for a vehicle according to claim 1, wherein, the second plate portion has a first nick residing around the first protrusion.

3. The heat exchange device for a vehicle according to claim 2, wherein, the vertical wall has a second nick residing around the second protrusion.

4. The heat exchange device for a vehicle according to claim 1, wherein, the vertical wall has a second nick residing around the second protrusion.

5. The heat exchange device for a vehicle according to claim 1, wherein when the end plate is retained in the first gap, the first plate portion and the first protrusion elastically hold the end plate.

6. The heat exchange device for a vehicle according to claim 5, wherein when the end plate is retained in the second gap, the second plate portion and the second protrusion elastically hold the end plate.

7. The heat exchange device for a vehicle according to claim 1, wherein when the end plate is retained in the second gap, the second plate portion and the second protrusion elastically hold the end plate.

8. The heat exchange device for a vehicle according to claim 1, wherein when the end plate is retained in the first gap, the first plate portion and the first protrusion directly engage the end plate, and an open space is defined between the end plate and the vertical wall of the shroud.

9. The heat exchange device for a vehicle according to claim 8, wherein when the end plate is retained in the second gap, the second plate portion and the second protrusion directly engage the end plate, and a second open space is defined between the end plate and the first plate portion.

10. The heat exchange device for a vehicle according to claim 1, wherein when the end plate is retained in the second gap, the second plate portion and the second protrusion directly engage the end plate, and an open space is defined between the end plate and the first plate portion.

11. The heat exchange device for a vehicle according to claim 1, wherein when the end plate is retained in the first gap, the second plate portion is disposed directly between the end plate and the vertical wall of the shroud.

12. The heat exchange device for a vehicle according to claim 11, wherein when the end plate is retained in the second gap, the first plate portion is not disposed directly between the end plate and the vertical wall of the shroud.

13. The heat exchange device for a vehicle according to claim 1, wherein when the end plate is retained in the second gap, the first plate portion is not disposed directly between the end plate and the vertical wall of the shroud.

14. The heat exchange device for a vehicle according to claim 1, wherein:

the heat exchanger is a first heat exchanger;

the shroud is configured to be separately attached to either the first heat exchanger or a second heat exchanger, the first heat exchanger and the second heat exchanger have different dimensions;

the first heat exchanger is a thin tube heat exchanger having thin tubes and a thin end plate;

the second heat exchanger is a thick tube heat exchanger having thick tubes and a thick end plate, which are thicker than the thin tubes and the thin end plate, respectively;

the first hook and the second hook are sized to hold the first heat exchanger in the first gap by elastically clamping the first heat exchanger between the first plate portion and the first protrusion; and the second hook and the second protrusion are sized to hold the second heat exchanger in the second gap by elastically clamping the second heat exchanger between the second plate portion and the second protrusion.

15. A shroud for attaching a fan to a heat exchanger for a vehicle, the shroud comprising:

a vertical wall defining a longitudinal direction that is substantially perpendicular to an air flow direction;

a first hook extending from the vertical wall towards the heat exchanger, the first hook including a first plate portion defining a first gap between the first plate portion and the vertical wall;

a second hook extending from the vertical wall towards the heat exchanger, the second hook including a second plate portion defining a second gap, which is less than the first gap, between the second plate portion and the vertical wall;

a first protrusion of the second hook protrudes toward the heat exchanger from the second hook, the first protrusion is elastically bendable; and a second protrusion protrudes from the vertical wall toward the heat exchanger and is elastically bendable;

wherein the first hook and the second hook are longitudinally offset from each other;

wherein:

the first hook and the second hook hold the heat exchanger in the first gap by elastically clamping an end plate of the heat exchanger between the first plate portion and the first protrusion when the heat exchanger has a first thickness; and the second hook and the second protrusion hold the heat exchanger in the second gap by elastically clamping the end plate of the heat exchanger between the second plate portion and the second protrusion when the heat exchanger has a second thickness that is greater than the first thickness.

* * * * *